United States Patent [19]

Ricco

[11] Patent Number: 4,928,888

[45] Date of Patent: May 29, 1990

[54] FAST SOLENOID VALVE, PARTICULARLY A FUEL INJECTION PILOT VALVE FOR DIESEL ENGINES

[75] Inventor: Mario Ricco, Bari, Italy

[73] Assignee: Weber S.r.l., Turin, Italy

[21] Appl. No.: 236,536

[22] Filed: Aug. 25, 1988

[30] Foreign Application Priority Data

Aug. 25, 1987 [IT] Italy ..... 53614/87[U]

[51] Int. Cl.[5] ..... F02M 41/16

[52] U.S. Cl. ..... 239/533.8; 239/585

[58] Field of Search ..... 239/533.3–533.12, 239/585; 251/129.01, 129.16

[56] References Cited

U.S. PATENT DOCUMENTS

| | | | |
|---|---|---|---|
| 3,464,627 | 9/1969 | Huber | 239/585 X |
| 4,005,733 | 2/1977 | Riddel | 251/129.16 X |
| 4,275,693 | 6/1981 | Leckie | 239/585 X |
| 4,390,130 | 6/1983 | Linssen | 251/129.16 X |

FOREIGN PATENT DOCUMENTS

| | | | |
|---|---|---|---|
| 102723 | 3/1984 | European Pat. Off. . | |
| 1169242 | 4/1964 | Fed. Rep. of Germany . | |
| 2507332 | 9/1976 | Fed. Rep. of Germany | 251/129.16 |
| 2817465 | 10/1979 | Fed. Rep. of Germany . | |
| 2058466 | 4/1981 | United Kingdom . | |
| 2185530 | 7/1987 | United Kingdom . | |

*Primary Examiner*—Andres Kashnikow

[57] ABSTRACT

An electromagnetically-controlled fuel injection valve for diesel engines includes a body (2) having an upper electromagnetic metering valve (10) including an obturator (11) supported by an armature (13) and controlling communication between a control chamber (9) and a fuel discharge port (A). A series of radial notches (14) which may be empty or filled with an insulating material is formed in the armature (13).

3 Claims, 1 Drawing Sheet

FAST SOLENOID VALVE, PARTICULARLY A FUEL INJECTION PILOT VALVE FOR DIESEL ENGINES

The present invention relates generally to electromagnetically-controlled fuel injection valves for diesel engines.

More particularly, the invention concerns an injection valve of the type comprising a body carrying a lower injection nozzle with which is operatively associated a needle controlling communication between the nozzle and an injection chamber supplied with fuel under pressure, and an upper metering valve including a body and a obturator carried by an armature and arranged to control communication between the control chamber, to which the fuel is supplied under pressure to keep the needle in the closed position, and a discharge port the opening of which causes a drop in pressure in the control chamber and the consequent opening of the needle.

In fuel injection valves of the type defined above, malfunctions may occur due to delays in the closing of the obturator of the electromagnetic valve caused by the inertia of the armature and parasitic currents, the hydrodynamic resistance offered by the fuel to its movement, and phenomena of sticking of the armature to the magnetic core of the valve as a result of residual magnetism.

In order to avoid these disadvantages, the subject of the present invention is an injection valve of the type defined at the beginning characterised in that the armature has a plurality of apertures, in the form of notches opening onto the peripheral edge of the armature itself.

These apertures may be empty or, alternatively, may be filled with an insulating material.

In both cases, there is a reduction in the weight and hence the inertia of the armature, and its overall magnetic inductance is also reduced so as to reduce the occurrence of parasitic currents. This ensures rapid detachment of the armature from the core of the metering valve during its energisation, thus ensuring a rapid closing movement of the obturator.

When the apertures in the armature are empty, the rapidity of closure of the obturator is further increased by virtue of the reduction in the hydrodynamic resistance opposed to the movement of the armature. On the other hand, when the apertures are filled with insulating material, usually a resin, the movement of the armature is damped with the result that the rebounding movements of the obturator during its closure are reduced.

Figure 1:
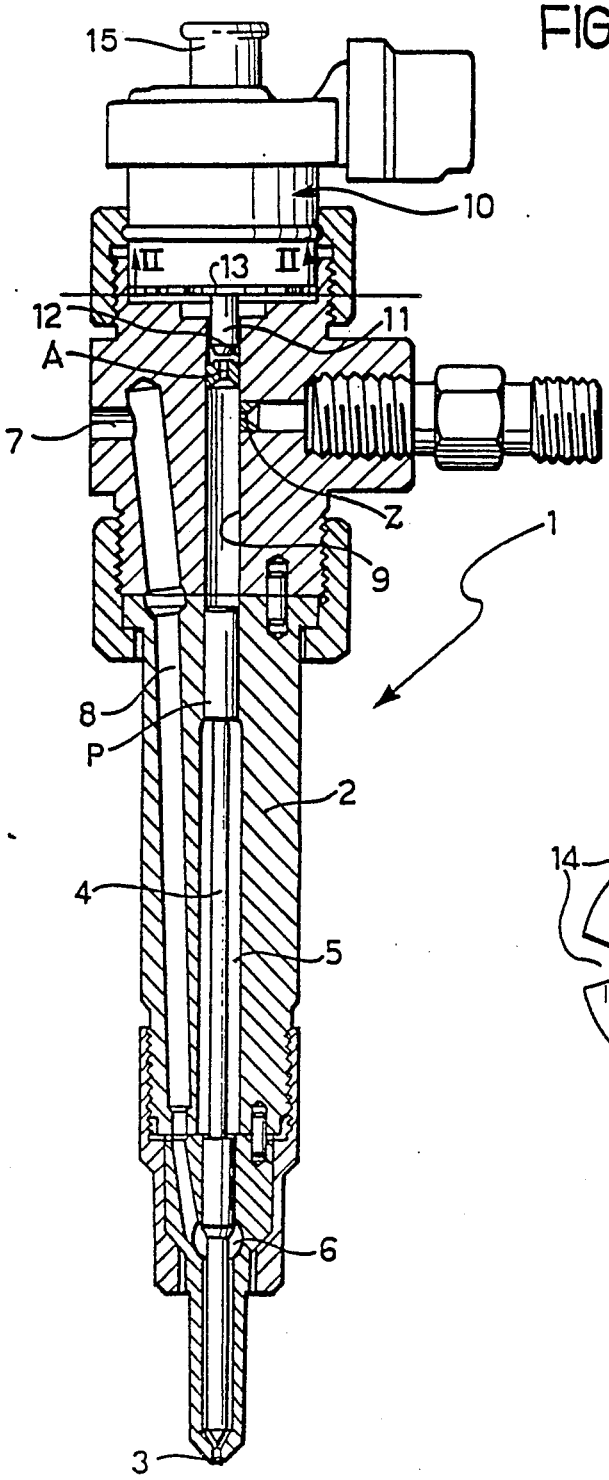
Figure 2:
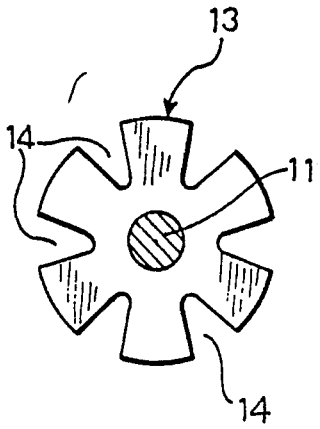

The invention will now be described in detail with reference to the appended drawings, provided purely by way of non-limiting example, in which FIG. 1 is a schematic, partial longitudinal sectional view of a fuel injection valve according to the invention, FIG. 2 is a cross-sectional view taken on the line II—II of FIG. 1 on an enlarged scale, and FIG. 3 is a modification of the armature shown in FIG. 2.

With reference initially to FIG. 1, a fuel injection valve for diesel engines is generally indicated 1 and includes essentially a body 2 the lower end of which defines an injection nozzle 3 with which a control needle 4 cooperates and is movable axially in a central cavity 5 in the body 2. This cavity 5 forms an injection chamber 6 close to the injection nozzle 3, to which fuel is supplied under pressure by a pump, not illustrated, from a supply inlet 7 and a passage 8.

The top of the cavity 5 forms a control chamber 9 to which the fuel is also supplied under pressure through an inlet port Z. A piston P secured to the needle 4 is slidable into the control chamber 9.

The control chamber 9 is also connected to a discharge through a discharge port A the opening and closing of which is controlled in known manner by means of an electromagnetically-controlled metering valve 10 whose obturator 11 slides in a guide 12 coaxial with the cavity 5 and is carried by a ferromagnetic armature 13. The guide 12 and therefore the port A communicates through an outlet 15 with the fuel supply means.

When the obturator 11 is in its position of closure of the discharge port A, the needle 4 is kept in the lowered position to prevent the passage of pressurised fuel from the injection chamber 6 to the injection nozzle 3. The opening of the discharge port A by the obturator 11 of the solenoid valve 10 causes a drop in pressure in the control chamber 9 and the consequent rising of the needle 4, whereby the pressurised fuel in the injection chamber 6 may be injected through the nozzle.

As illustrated in greater detail in FIG. 2, the armature 13 has a generally circular shape and, according to the invention, is provided with a plurality of apertures in the form of radial notches 14 which are equiangularly spaced from each other and open onto the peripheral edge of the armature itself. The notches 14 may be empty, as in the embodiment illustrated, or alternatively may be filled with an insulating material 16, normally a resin.

The above-described configuration of the armature 13 enables the obturator 11 to move rapidly from the open position to the closed position of the discharge port A by virtue of the reduction in the overall magnetic inductance of the armature 13 and hence in the formation of parasitic currents. This effect is accentuated by the reduction in the weight, and hence the inertia, of the armature 13 due to the presence of the notches 14, as well as the reduction in the hydrodynamic resistance offered by the fuel to the movement of the armature itself when the notches in the latter are empty.

When the notches 14 are filled, however, an advantageous damping effect is achieved which enables the rebounding of the obturator 11 during ita closure to be reduced.

What is claimed is:

1. An electromagnetically-controlled fuel injection valve for diesel engines, including:

a hollow body housing an injection chamber and a control chamber both supplied with fuel under pressure, an injection nozzle provided at one end of said hollow body and communicating with said injection chamber, a needle operatively associated with said nozzle to control communication between said injection chamber and said nozzle, piston means secured to said needle and cooperating with said control chamber to keep said needle in a position closing said communication by the sole action of said fuel under pressure, and an electromagnetic metering valve mounted at the other end of said hollow body, said metering valve comprising:

a discharge port communicating with said control chamber, the opening of which causes a drop in the pressure of said control chamber to cause said piston to move said needle to a position opening said communication, an obturator normally closing said discharge port, a selectively energizable cylindrical solenoid secured to said hollow body, an armature secured to said obturator and operable by said solenoid to cause said obturator to open said discharge port, said armature having a generally circular shape and being provided with a plurality of apertures in the form of radial notches, which open onto the peripheral of said armature to reduce the inertia and the overall magnetic inductance of said armature and hence the formation therein of parasitic electric currents.

2. A valve according to claim 1 wherein the apertures are empty.

3. A valve according to claim 1 wherein the apertures are filled with an insulating material.

* * * * *